United States Patent [19]

Nagaoka et al.

[11] Patent Number: 4,612,433

[45] Date of Patent: Sep. 16, 1986

[54] THERMAL HEAD AND MANUFACTURING METHOD THEREOF

[75] Inventors: Makoto Nagaoka, Urawa; Tetsuya Sugiyama, Soka, both of Japan

[73] Assignee: Pentel Kabushiki Kaisha, Tokyo, Japan

[21] Appl. No.: 686,245

[22] Filed: Dec. 26, 1984

[30] Foreign Application Priority Data

Dec. 28, 1983 [JP] Japan ..... 58-251886
Apr. 11, 1984 [JP] Japan ..... 59-72412

[51] Int. Cl.[4] ..... B41J 3/20
[52] U.S. Cl. ..... 219/216; 346/76 PH
[58] Field of Search ..... 219/216 PH, 543; 400/120; 346/76 PH; 338/308, 309, 314; 29/611, 620, 621; 106/86, 87

[56] References Cited

U.S. PATENT DOCUMENTS 4,417,257 11/1983 Mitsui ..... 219/216 PH
4,463,246 7/1984 Tatsumi ..... 219/216 PH

FOREIGN PATENT DOCUMENTS 2721703 11/1977 Fed. Rep. of Germany ..... 338/308
54-55449 2/1979 Japan ..... 400/120
55-114579 9/1980 Japan ..... 346/76 PH
57-24275 2/1982 Japan ..... 400/120
57-64576 4/1982 Japan ..... 219/216 PH
58-59864 4/1983 Japan ..... 400/120

OTHER PUBLICATIONS

Hashimoto, Kaoru, "Selective Glaze . . . ", Electrocomponent Sci. and Tech., vol. 8, Nos. 1 & 2, pp. 115–121.
Anderson, Carl M., "The Development of . . . ", Int. J. Hybrid Microelectron., vol. 4, No. 1, (Spring 1981), pp. 24–30.,

*Primary Examiner*—Clarence L. Albritton
*Assistant Examiner*—Teresa Walberg
*Attorney, Agent, or Firm*—Robert E. Burns; Emmanuel J. Lobato; Bruce L. Adams

[57] ABSTRACT

A thermal head is defined as is its manufacture, the thermal head being produced on a substrate by forming a glaze layer having a number of bubbles by printing on it a glass paste containing a glass powder that contains at least 20% by weight or more of a finely divided glass powder with an average particle diameter of up to 5 μm followed by calcining, and forming a heat generating resistor, an electrode and a protective layer successively on the glaze layer.

10 Claims, 4 Drawing Figures

THERMAL HEAD AND MANUFACTURING METHOD THEREOF

BACKGROUND OF THE INVENTION

The invention relates to a thermal head that will be used in a heat sensitive recording apparatus that converts an electrical signal to a thermal signal and uses the Joule heat of a tiny thin film resistor thereby developing color in a heat sensitive recording medium to be recorded and also relates to the production of the heat.

The heat sensitive recording system that is a typical nonimpact system is widely and generally used since the heat sensitive recording system makes no noise and has other advantages. Since the glaze layer positioned under the heat generating section of a thermal head used in a heat sensitive recording system has great influence on the printing efficiency and printing quality, various studies have been made on the glaze layer.

Generally a glaze layer having a low heat conductivity is considered preferable to be used as a glaze layer of a thermal head, since such a glaze layer can secure efficiently the amount of heat required for printing by reducing the amount of heat escaping to the substrate of the head when electric power is applied through an electrode means to the heat generating section of a resistor. However, in practice, when the amount of heat for printing is to be sufficient for requirements, the thickness of the glaze layer must have at least a certain thickness or over, and if the thickness is too great, the accumulated amount of heat will become high. As a result, when an electric current is not applied, that is, when cooling is effected, the heat radiation will become relatively insufficient, and a quick lowering of temperature will not be attained, resulting in undesired printing. A glaze layer for a thermal head is thus required to have contradictory properties.

To deal with this, it has been proposed in Japanese Laid-Open Patent Application No. 74370/1983 that a glaze layer positioned under the heat generating section of a thermal head be made up of a glass simply having a great number of bubbles. Since this thermal head uses as a glaze layer a glass having a low heat conductivity and there are a great number of pores (bubbles) present in the glaze layer, the heat conductivity as a whole becomes low owing to the pores in comparison to one having no pores, and the heat accumulation becomes low at a certain temperature. That is, if a glaze layer having pores is formed to have the same appearance as a glaze layer having no pores, the glaze layer having pores has a lower heat conductivity and accumulates a lesser amount of heat than in the case of a glaze layer having no pores. Therefore the glaze layer made up of said material is excellent in that a thermal head comprising the glaze layer is improved in attaining of a printing temperature and a quick increase in temperature when electric power is applied, and has favorable heat response.

However, when such a glaze layer is to be produced in practice, many problems will be concurrently met. That is, generally when a glass having a great number of bubbles is to be produced, a paste of a glass powder having an average particle diameter on the order of about 10 to 50 μm is calcined under certain conditions, during which bubbles are generated in the paste. When this is used for the production of a glaze layer of a thermal head, the calcining temperature must be controlled on the order of a preciseness of ±2° to 3° C. and this results in technically higher setting of the calcining conditions and technical difficulty. Further, if suitable calcining conditions are not maintained, the glass powder bubbles generated in the paste will not remain in the glaze layer but will appear at the surface and make the surface rough, which has an adverse effect on the printed quality in practice, and therefore there is a risk that a thermal head will be provided which is good in heat response but lacks commercial value.

SUMMARY OF THE INVENTION

This invention is based on the above knowledge and the object of the invention is to provide a thermal head that has excellent heat response, can provide good printing quality, and can be produced efficiently in high yield and to provide a method for the production of such a thermal head.

According to the present invention, there is provided a thermal head comprising a substrate, a glaze layer having a number of bubbles, the glaze layer being formed by printing on the substrate a glass paste of which the glass component is a glass powder composition of 20 to 100% by weight of a finely divided glass powder having an average particle diameter of up to 5 μm and 0 to 80% by weight on the basis of the total glass composition of a glass powder having an average particle diameter of 8 to 20 μm, followed by calcining, together with a heat generating resistor, electrode means and a protective layer formed successively on the glaze layer.

The prevent invention also provides a method of producing a thermal head including the step of printing on a substrate a glass paste of which the glass component is a glass powder composition of 20 to 100% by weight of a finely divided glass powder having an average particle diameter of up to 5 μm and 0 to 80% by weight on the basis of the total glass composition of a glass powder having an average particle diameter of 8 to 20 μm. The step of calcining the glass paste in such a way that a number of bubbles is formed in a resultant glaze layer.

According to a preferred embodiment of the present invention, the protective film is made of silicon that contains 5 to 40% on an atomic basis of nitrogen. Further, an insulating material layer having a thickness of 1 to 10 μm is interposed between the glaze layer and the heat generating resistor. According to another preferred embodiment of the invention, the glaze layer is in the form of a ridge and a ridge section having an abutting width wider than the abutting width with a heat sensitive object is formed on said substrate with an interval between the glaze layer and the ridge section.

The above object and other objects and the effect of the present invention will be apparent from the following detailed description.

BRIEF DESCRIPTION OF THE DRAWINGS

It is noted that similar parts of the embodiments shown in the figures have been identified by the same reference numeral.

DETAILED DESCRIPTION OF THE ILLUSTRATED EMBODIMENTS

The invention will now be explained in more detail with reference to the accompanying drawings wherein preferred embodiments of the present invention are illustrated.

Figure 1:
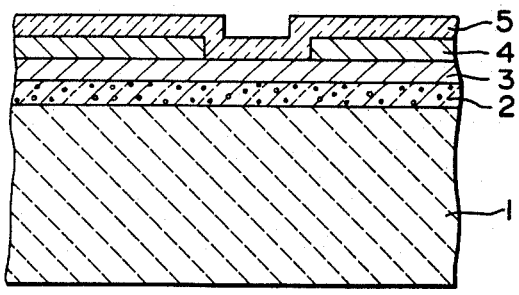
FIG. 1 is a vertical sectional view of the essential parts of an embodiment of the present thermal head.

Referring to FIG. 1, reference numeral 1 indicates a substrate made of alumina ceramic or the like, and a glaze layer 2 positioned on substrate 1 and having a large number of bubbles. The glaze layer 2 is formed by printing and baking a glass paste of which the glass component is a glass powder mixture of 20 to 100% by weight of a finely divided glass powder having average particle diameter of up to 5 μm and 0 to 80% by weight on the basis of the total glass composition of a glass powder having an average particle diameter of 8 to 20 μm. A heat generating resistor 3 consisting of a silicide of titanium, vanadium, chromium, molybdenum, zirconium, tungsten, tantalum or the like is layered on the glaze layer 2. Electrode means 4 of an alloy of gold, aluminum or the like is layered on the heat generating resistor 3, and a protective film 5 of silicon or the like to which nitrogen is added is applied on the electrode means 4. Thus a thermal head is formed.

The glaze layer 2 is the most important distinguishing feature of the invention. Since the glass paste of which the glaze layer 2 is made contains at least 20% by weight of a finely divided glass powder, based on the total amount of said glass powder mixture, in particular having an average diameter of up to 5 μm, and moisture and gaseous materials adsorbed on the finely divided glass powder are lowered in amount, when the glass paste is calcined and the moisture and the gaseous materials are desorbed to form bubbles, the bubbles are very fine. Therefore, even if the bubbles are exposed on the surface of the glaze layer, the state of the surface is not so rough as to influence the printing quality adversely. Further, due to this, less consideration is given to suppressing the generation of bubbles at the time of calcination or the exposure of the bubbles to the surface.

The proportion of the finely divided glass powder used in the present invention is at least 20% by weight, preferably 50 to 100% by weight, based on the total amount of said glass mixture. When the proportion of the finely divided glass powder is less than 20% by weight, based on the total amount of said glass powder mixture, the surface of the glaze layer is roughened, so that it becomes difficult to obtain the desired smoothness of the glaze layer. The average particle diameter of the finely divided glass powder is preferably on the order of about up to 5 μm. Furthermore, taking into consideration the reduction of the number of bubbles that will appear on the surface of the glaze layer and the size (pore diameter) of the bubbles or the porocity in the glaze layer when the printed glass paste is calcined, the average particle diameter of the finely divided glass powder is particularly preferred to be from 0.5 to 1.0 μm. If the size of the bubbles is too large, or the porocity is too high, the glaze layer will lack mechanical strength or will have unfavorable durability. Therefore when a finely divided glass powder to be mixed with a common glass powder has an average particle diameter of 0.5 to 1.0 μm, a glaze layer having the most preferable property can be obtained. According to the experiments carried out by the inventors, it has been found that the pore diameter is in particular preferably up to 10% of the thickness of the glaze layer, and the porosity is in particular preferably in the range of 10 to 30%.

The finely divided glass powder is added with or without a glass powder having an average particle diameter of 8 to 20 μm, to a solution of an ethyl cellulose, nitrocellulose or the like in terpineol or the like and is kneaded into a glass paste, the glass paste is printed on a substrate of alumina ceramic or the like by a screen printer made up into a prescribed size, and after drying, the glass paste is calcined at a temperature that is higher than the softening point of the glass employed by 50° to 150° C. to obtain readily a desired glaze layer of a glass having a number of bubbles.

The invention will now be explained in detail by reference to the following examples.

EXAMPLE 1

50% by weight of a finely divided glass powder having a softening point of 630° C. and an average particle diameter of 0.5 μm and 50% by weight of a glass powder having a softening point of 630° C. and an average particle diameter of 10μm were mixed, and the mixture was kneaded with a vehicle containing 5% of an ethyl cellulose dissolved in α-terpineol to prepare a glass paste. The glass paste was printed by screen printing on an alumina substrate to provide a layer having a width of 0.5 mm, a length of 10.0 mm and a thickness of 65μ, and after it was dried at 100° C., it was calcined at 740° C. for 15 min and then cooled to obtain a glaze layer positioned on the substrate and having a number of bubbles. On this glaze layer were successively formed by sputtering a $Si\text{-}O_2$ film, a $TiSi_2$ layer that can act as a heat generating resistor, and an aluminum alloy layer that can act as electrode means followed by patterning, and finally a silicon layer to which nitrogen was combined and that can act as a protective film were formed to obtain a thermal head.

EXAMPLE 2

Example 1 was repeated, with the exception that 22% by weight of the finely divided glass powder and 78% by weight of the other glass powder were used.

EXAMPLE 3

Example 1 was repeated, with the exception that 80% by weight of the finely divided glass powder and 20% by weight of the other glass powder were used.

EXAMPLE 4

Example 1 was repeated, with the exception that 100% by weight of the finely divided glass powder was used.

EXAMPLE 5

Example 1 was repeated, with the exception that the finely divided glass powder had an average particle diameter of 0.4 μm, and the other glass powder had an average particle diameter of 20 μm.

EXAMPLE 6

Example 1 was repeated, with the exception that the finely divided glass powder had an average particle diameter of 1.5 μm.

COMPARATIVE EXAMPLE 1

Example 1 was repeated, with the exception that the finely divided glass powder was not used, only a glass powder having an average diameter of 10 μm was used and the calcination was carried out at 740° C. for 40 min.

COMPARATIVE EXAMPLE 2

Example 1 was repeated, with the exception that 10% by weight of the finely divided glass powder and 90% by weight of the other glass powder were used.

The glaze layers obtained in Examples 1 to 6 and Comparative Examples 1 and 2 and the thermal heads obtained using these glaze layers were examined. The results are given in Table 1.

TABLE 1

| Experiment No. | Surface of glaze layer* | Cross section of glaze layer | Printing performance |
|---|---|---|---|
| Example 1 | Smooth | Bubbles having a pore diameter of 0.1 to 5 μm were about 20%. | good |
| Example 2 | smooth | Bubbles having a pore diameter of 0.1 to 3 μm were about 15%. | good |
| Example 3 | smooth | Bubbles having a pore diameter of 0.1 to 7 μm were about 30%. | good |
| Example 4 | smooth | Bubbles having a pore diameter of 0.1 to 7 μm were about 35%. | good |
| Example 5 | smooth | Bubbles having a pore diameter of 0.1 to 5 μm were about 30%. | good |
| Example 6 | smooth | Bubbles having a pore diameter of 0.1 to 3 μm were about 15%. | good |
| Comparative Example 1 | very rough | Bubbles having a pore diameter of 0.1 to 8 μm were about 10%, but there were many bubbles exposed to the surface. | Contact of the heat generating section with the heat sensitive section was unfavorable and uneven density occurred. |
| Comparative Example 2 | smooth | Bubbles having a pore diameter of 0.1 to 3 μm were about 4%. | Thermal responsibility was unfavorable and thin lines appeared. |

*the surface and the cross section of the glaze layers were observed by a scanning electron microscope.

As will be understood from Table 1, according to the present invention the glaze layer provides a thermal head having excellent properties.

Now, the protective film 5 shown in FIG. 1 will be described.

It is general practice to provide a protective film to prolong the use-life of a thermal head. That is, a protective film can prevent a heat generating resistor or electrode means from being abraded as a result of its contact with a heat-sensitive paper or heat-sensitive ribbon, and the deteriorating reaction of a heat generating resistor with atmospheric oxygen is suppressed. Therefore, a protective film is required to be high in abrasion resistance and low in oxygen permeability.

However it is difficult for both such requirements to be satisfied simultaneously, and if the thickness of a protective film is simply increased, the thermal response would deteriorate. Further, a thermal head that has the glaze layer mentioned above and is high in thermal response is produced, if the thermal head is operated under high electric power and at high speed, and if the abrasion resistance and tear resistance of the protective film itself are not adequate, the life of the thermal head is shortened.

Accordingly the present invention uses a protective film of silicon containing chemically from 5 to 40% on an atomic basis of nitrogen. The proportion of nitrogen in the nitrogen-containing silicon protective film is 5% on an atomic basis, preferably 10% or more, and up to 40%, preferably up to 30%, based on the total amount. If the proportion of the nitrogen is up to 5% on an atomic basis, though oxidation resistance and tear resistance can be satisfied, abrasion resistance is not enough, while if the proportion thereof is over 40% on an atomic basis, though abrasion resistance can be satisfied, the oxidation resistance and tear resistance are not adequate.

Now, with respect to a protective film, further description will be given with reference to the following Examples and Comparative Examples.

EXAMPLE 7

A thermal head was produced by successively layering or applying, on a substrate of alumina ceramic, a glaze layer of a glass having a porosity of 20%, a insulating material layer of silicon oxide, a heat generating resistor of titanium silicide, electrode means comprising an upper layer of aluminum and a lower layer of molybdenum, and a protective silicon film containing chemically 7% on an atomic basis of nitrogen and having a thickness of 5 μm. In this case, the glaze layer was formed by screen printing of a glass glaze, the insulating material layer, the heat generating resistor and the electrode means were formed by sputtering, and the protective film was formed by ion plating of silicon in a nitrogen-containing gas.

EXAMPLES 8 AND 9

To produce thermal heads, Example 7 was repeated, with the exception that the proportion of the nitrogen in the protective film was 20% on an atomic basis and 35% on an atomic basis respectively.

COMPARATIVE EXAMPLES 3 AND 4

To produce thermal heads, Example 7 was repeated, with the exception that the proportion of the nitrogen in the protective film was 2% on an atomic basis and 50% on an atomic basis respectively.

COMPARATIVE EXAMPLE 5

To produce a thermal head, Example 7 was repeated, with the exception that the protective film had a lower layer of silicon oxide having a thickness of 2 μm and an upper layer of tantalum oxide having a thickness of 3 μm.

The test results with respect to the thermal heads obtained in Examples 7 to 9 and Comparative Examples 3 to 5 are given in Table 2.

TABLE 2

| Experiment No. | Abrasion resistance (note 1) | Tear resistance (note 2) | Use-life (note 3) |
|---|---|---|---|
| Example 7 | about 0.04 μm | 2.2 W/dot | about $4.5 \times 10^8$ dots |
| Example 8 | about 0.0035 μm | 2.0 W/dot | about $5.5 \times 10^8$ dots |
| Example 9 | about 0.02 μm | 1.7 W/dot | about $4 \times 10^8$ dots |
| Comparative Example 3 | about 0.0075 μm | 2.4 W/dot | about $3 \times 10^8$ dots |
| Comparative Example 4 | about 0.0015 μm | 1.1 W/dot | about $3 \times 10^7$ dots |
| Comparative Example 5 | about 0.0045 μm | 1.4 W/dot | about $3 \times 10^8$ dots |

(note 1):
When electric power of 0.9 W/dot (pulse period: 2 ms, pulse width: 0.7 ms) was applied, and the thermal head was run on heat-sensitive paper with the printing pressure being 200 g, abrasion per 1 km was measured.
(note 2):
Puncture voltage of the heat generating resistor was measured by the step stress test (pulse period: 2 ms, pulse width: 0.7 ms, applied electric power was increase at every $10^5$ pulses). There is a great relationship between the breakage of the heat generating resistor and the occurrence of cracks in the protective film.
(note 3):
By continuing the running stated under Note 1, and the number of dots was measured until the thermal head became useless because the printed characters were unclear due to the change in resistance value.

The results given in Table 2 will now be discussed.

The tear resistance of Comparative Example 3 is the best of all Examples, but since the abrasion resistance is worse, the use-life is not long. The abrasion resistance of Comparative Example 4 is the best of all Examples, but since the tear resistance is worse, cracks appeared before it exhibited enough abrasion resistance, and the thermal head could not be used under the test conditions, except under conditions where a low electric power was applied and a low speed was used. The abrasion resistance and the tear resistance of Comparative Example 5 were inferior to those of Examples 6 to 8. It will be clearly understood that the use-life of Comparative Example 5 was worse. A combination of the properties of a protective film determines the use-life of a thermal head. According to the present invention, a thermal head having a long use-life can be provided and if it is desired that a property such as printing response is improved, the use-life can be prolonged and the protective film can be correspondingly made thinner.

An insulating layer that is one aspect of the present invention will now be described.

A glaze layer having a suitable length for example of 10 μm can be obtained by calcining a glass paste at a considerable high temperature of 600° C. or 700° C., but in order not to increase the change of resistance value of a thermal head with time, it is required that it should be subjected to its crystallization temperature or over in forming the heat generating resistor. Therefore, when a heat generating resistor is formed, a substantial high temperature stage is required. Since the produced glaze layer will be subjected to a high temperature, adverse effects that will be caused by undesired deformation of the glaze layer such as a decrease in yield at the patterning, scattering of the resistance value set for the heat generating resistor, cracks appearing in the protective film, and the occurrence of undesired thin line formation at the time of transferring are quite significant. Therefore, for the purpose of prolonging the life of a thermal head, if a silicide of a high melting point metal such as titanium, tantalum, tungsten or the like whose crystallization temperature is 500° C. or over is selected as a material for the thermal head, the above problems can be solved.

Figure 2:
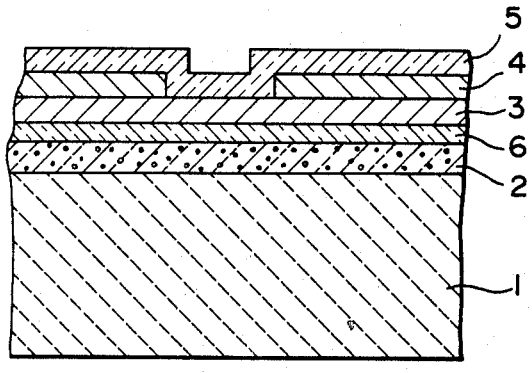
FIG. 2 is a vertical sectional view of the essential parts of another embodiment of the present thermal head.
Figure 3:
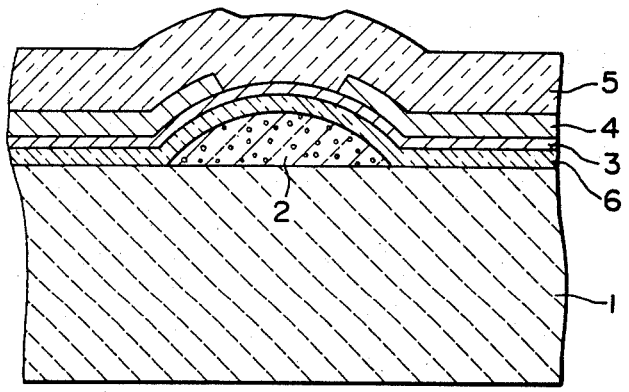
FIG. 3 is a vertical sectional view of the essential parts of still another embodiment of the present thermal head.

As a result of taking the above points into consideration, in the present invention, an insulating material layer having a thickness of 1 to 10 μm is interposed between a glaze layer and a heat generating resistor. This will be described with reference to FIG. 2. The thermal head in FIG. 2 is different from the thermal head in FIG. 1 in that the thermal head in FIG. 2 has an insulating material layer 6 positioned between a glaze layer 2 and a heat generating resistor 3. Though the insulating material layer 6 is formed at least at the position where the heat generating resistor 3 is positioned over the glaze layer 2, it will be easy to form the insulating material layer 6 to cover all the surface of the glaze layer 2 by sputtering or the like. As a matter of course, the configuration of the glaze layer in the present invention may be partially in the form of a ridge as shown in FIG. 3.

A material for the insulating layer 6 will not be restricted so long as the material has insulating properties, for example silicon oxides, alumina, silicon nitride, tantalum oxide, silicon carbide, high resistance silicon, etc. can be mentioned as materials for the insulating layer, a material high in thermal shock resistance and low in heat conductivity is desirable, and silicon oxides such as $SiO_2$ are typical materials. The thickness of the insulating layer is in the range of from 1 to 10 μm. If the thickness of the insulating layer is up to 1 μm, the effect of the presence of the insulating layer will not be apparent, while if the thickness is 10 μm or more, the value of the glaze layer having a number of bubbles, that is, the thermal response will disappear. More preferably the thickness of the insulating material layer is on the order of 2 to 4 μm.

As stated above, by interposing an insulating layer having a thickness of from 1 to 10 μm between a glaze layer having a number of bubbles and a heat generating resistor, the yield will be improved and scattering of the resistance value of the heat generating resistor will be reduced. Further, the favorable thermal response due to the glaze layer having a number of bubbles can be readily apparent, and a quality thermal head having a long life can be provided. The results for tests for thermal heads are given in Table 3 which tests were conducted by applying electric power of 0.65 W for $5 \times 10^{-4}$ sec for a period of $2 \times 10^{-3}$ sec. The thermal heads were produced as test samples by screen-printing a glass paste on a ceramic substrate, calcining the glass paste at 700° C. to form a glaze layer having a thickness of about 60 μm and containing about 20% of randomly distributed bubbles with a size of about 0.1 to 5 μm, forming thereon an insulating layer of silicon oxide by sputtering at a maximum temperature of 400° C. with the thickness being varied in each case, forming thereon a heat generating resistor of titanium silicide by sputtering at a maximum temperature of 555° C., and then forming thereon electrode means formed of an aluminum alloy and then a protective layer of silicon to which nitrogen was combined and having a thickness of about 5 μm.

TABLE 3

| | Example 10 | Example 11 | Example 12 | Comparative Example 6 |
|---|---|---|---|---|
| The thickness of the insulating layer | about 1 μm | about 3 μm | about 3 μm | about 0.2 μm |
| Printed state | In comparison to Example 11, though uneven shade was observed a little, the state was good. | quite good | In comparison to Example 11, though unclear profiles of transferred letters were observed a little, the state was good. | Thin lines appeared, and uneven shade was conspicuous |
| Life | about $4 \times 10^8$ dots | about $1 \times 10^9$ dots | about $6 \times 10^8$ dots | about $8 \times 10^7$ dots |

As will be understood from the results given above, it will be clear that when an insulating layer having a thickness of 1 to 10 μm is provided between the glaze layer of the present invention and the heat generating resistor, an excellent thermal head can be provided.

Another aspect of the present invention, that is, the formation of the glaze layer into a ridge and the formation of a ridge section having an abutting width wider than the width which will contact a heat sensitive object will now be described.

As stated above the glaze layer may be formed with a ridge. If the glaze layer is formed into a ridge, the temperature required for printing can be efficiently assured by reducing the amount of heat escaping to the substrate when electric power is applied to the heat generating section of the heat generating resistor, and further heat radiation can be quickly brought about when electric power is not applied, that is, when it is cooled. Therefore, with respect to this point, it is desired that the configuration of the ridge of the glaze layer be as high as possible and as narrow as possible.

However when these conditions are satisfied, other problems will arise between the thermal head and a heat sensitive object such as heat sensitive paper or heat transfer film. That is, since the height of the glaze layer is large in comparison to the thickness of the heat generating resistor, the electrode means, or the protective film, the abutting or contact against a heat sensitive object is made by the ridge section if another layer is formed on the glaze layer for some purpose. However, when the width of the glaze layer is narrowed, the abutting or contact width thereof is also narrowed, and therefore a result is that the abutting pressure on a heat sensitive object becomes high. If the heat sensitive object was printed only by sensing heat, the high abutting or contact pressure could be ignored. However, since a common heat transfer film comprises for example a thin plastic film on which a transferring medium is formed, if the abutting or contact pressure is high, unrequired transferring will occur due to mechanical impact.

Therefore, in the present invention, to lower the abutting or contact pressure, in addition to the widening of the glaze layer, an abutting or contact ridge section which is not for the purpose of printing as well as a ridge section which is for the purpose of printing is formed for contact with a heat sensitive object.

When the glaze layer is to be narrowed, that is, the abutting width of the ridge section is to be narrowed, if the additionally formed ridge section has a narrow abutting width, the effect of lowering the abutting or contact pressure may not be enough, so that a plurality of such additional ridge sections are required to be formed. Although there is no problem if such additional ridge sections were uniformly abutted against a heat sensitive object, non-uniform abutting will result as a result of their uneven height in many cases.

Figure 4:
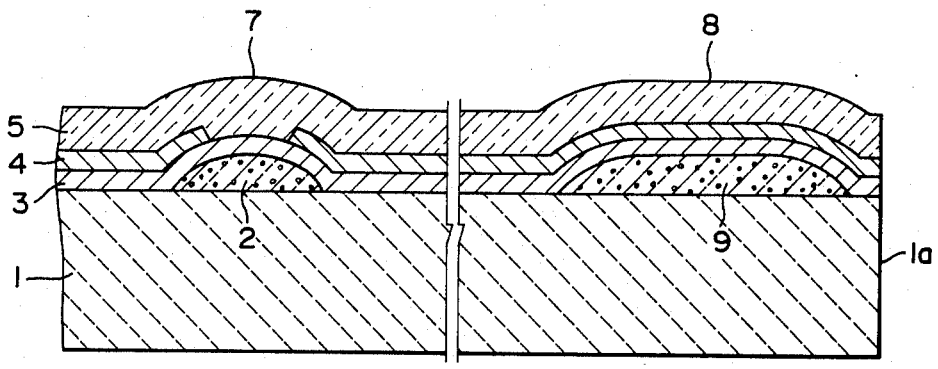
FIG. 4 is a vertical sectional view of the essential parts of still another embodiment of the present thermal head.

In view of the above situtation, the height of glaze layer 2 shown in FIG. 4 is as high as possible and the width is formed as narrow as possible. Therefore, ridge section 7 is also narrow. In contrast, the additionally formed ridge sections 8 is rather wide. The ridge section 8 is formed as high as the ridge section 7 on an insulating substrate 1, and is to have a suitable height depending on the abutting or contact angle with a heat sensitive object. The fact that the ridge section 8 is as high as the ridge section 7 is due to the fact that ridge body 9 that is the lowermost layer is as high as the glaze layer 2. The ridge body 9 is formed by screen printing, together with the glaze layer 2 when the glaze 2 is printed, using the same paste, and calcining simultaneously with the glaze layer 2 so that the same height as that of the glaze layer can be readily obtained. However, if it is intended that the ridge body 9 be made wide, and since an undesired irregular surface will be formed on the upper surface (abutting side) due to deformation at the time of calcining, it is preferred that only one ridge be formed and have a smooth curve in cross section as shown in FIG. 4. In general, when the width is 2 mm or less at the time of screen printing, an irregular surface will rarely occur.

On the ridge body 9 are formed layers corresponding to the heat generating resistor 3, the electrode means 4, and the protective layer 5 over the glaze layer 2. Since the electrode means 4 on the side of the glaze layer 2 is partially cut, and strictly speaking though there is a difference in height, the difference can be ignored in practice as the thickness of the electrode means 4 is in general on the order of several μm. The layers on the ridge body 9 corresponding to the heat generating resistor 3, etc. may be in communication with or independent of the layers on the glaze layer 2 depending on the patterning by the photolithography or the like.

If a heat sensitive object is a heat transfer film, since it is generally in the form of a tape or ribbon having a constant width, it is desirable that the length (the vertical distance in the figure) of the ridge body 9 be longer than the tape width or the width of the transferring matter. Further, is is desirable that the ridge body 9 be formed along or adjacent to a side wall 1*a* of the insulating substrate 1. This is because the occurrence of transferring is to be prevented and will be caused by unnecessary mechanical impact when a tapelike heat transfer film is deflected by the abutment or contact of the thermal head, and it abuts or contacts on the longitudinal end of the ridge body 9 or the side wall 1*a* of the insulating substrate 1.

An example of the production of a thermal head will be given below.

On an alumina substrate (a rectangular plate having a length of 25 mm, a width of 12 mm and a thickness of 0.6 mm) were printed by screen printing a glass paste as a strip having a width of 0.45 mm along its length and spaced 0.8 mm from one of the longer sides, and a glass paste as a strip having a width of 1.5 mm along the length of the substrate and spaced 0.5 mm away from the other longer side. Each of the printed glass pastes began from one of the shorter sides. and had a length of 10 mm. These pastes were calcined to obtain a ridge body having an arcuate crosssection (approximately an arc having a radius of about 650 μm) and a ridge body having a crosssection similar to half of the former ridge body and extended laterally. That is, the former ridge body formed a glaze layer 2 and the latter ridge body formed a ridge body 9 (see FIG. 4). Both the ridge bodies had a height of about 40 μm, and the ridge body 9 had a radius of about 1800 μm when regarded as an arc. Upon them were physically and successively deposited titanium silicide as a heat generating resistor 3: 0.05 μm in thickness, molybdenum as part of electrode 4: 0.3 μm in thickness and aluminum as part of eletrode means 4: 2 μm in thickness and a pattern was formed by photolithography. The interval between parts of electrode means 4 on the glaze layer 2, that is, the length of the part where the resistor 3 is exposed (the right and left parts in FIG. 4) was 0.16 mm. Further, silicon nitride (a protective film 5: 4 μm in thickness) was physically deposited thereon to obtain a thermal head.

This terminal head was compared with a thermal head similarly produced but without the ridge body 9 and a thermal head similarly produced with the exception that the size and configuration of the ridge body 9 and those of the glaze layer 2 were the same. A heat sensitive object was a tape-like heat transfer film (Thermal Carbon Ribon produced by Fuji Kagakushi Kogyo KK) having a width of 8 mm, the abutting or contact force against the heat transfer film was 100 g, the dot period was 2 millisec and the applied electric power was zero.

A black line corresponding to the tape width was continuously printed on a recording paper when the thermal head without the ridge body 9 was used, whereas when the thermal head wherein the size and the configuration of the ridge body 9 and those of the glaze layer 2 was used, two similar faint black lines were printed per dot, but unnecessary printing did not occur in the case of this thermal head. When this thermal head was used under an applied electric power of 0.75 W/dot, unnecessary printing due to mechanical impact was not observed. Further when the ridge body having a width 0.8 mm or 2 mm was tested when screen printing was carried out, good results was obtained also.

As state above, in addition to the ridge 7 formed by the glaze layer 2, when the ridge section 8 having an abutting width wider than the abutting width of the ridge section 7 is also formed, clear thermal printing without unnecessary printing due to mechanical impact becomes possible.

It is obvious that an insulating layer as described above may be interposed between the heat generating resistor 3 and the glaze layer 2 and also the protective layer 5 may be made of silicon that contains from 5 to 40% of an atomic basis of nitrogen.

We claim:

1. A thermal head comprising a substrate, a glaze layer formed on said substrate, and a heat generating resistor and electrode means formed successively on said glaze layer, wherein said glaze layer is formed by printing on said substrate a glass paste of which the glass component comprises a glass powder composition of 20 to 100% by weight of a finely divided glass powder having an average particle diameter of up to 5 μm and 0 to 80% by weight on the basis of the total amount of said glass powder composition of a glass powder having an average particle diameter of 8 to 20 μm, and by calcining said glass paste on said substrate to form a plurality of bubbles in said glaze layer.

2. A thermal head as claimed in claim 1, wherein said average particle diameter of said finely-divided glass powder is from 0.5 to 1.0 μm.

3. A thermal head as claimed in claim 1, further comprising a protective layer of silicon which contains 5 to 40% on an atomic basis of nitrogen on said heat-generating resistor and said electrode means.

4. A thermal head as claimed in claim 1, wherein said glaze layer is in the form of a ridge and a ridge section having a width wider than the width which would contact a heat sensitive object is formed on said substrate with a distance existing between said glaze layer and said ridge section.

5. A thermal head as claimed in claim 2, further comprising a protective layer of silicon which contains 5 to 40% on an atomic basis of nitrogen on said heat-generating resistor and sais electrode means.

6. A thermal head as claimed in claim 2, wherein said glaze layer is in the form of a ridge and a ridge section having a width wider than the width which would contact a heat sensitive object is formed on said substrate with a distance existing between said glaze layer and sid ridge section.

7. A method for producing a thermal head comprising a substrate, a glaze layer on said substrate, and a heat generating resistor and electrode means formed successively on said glaze layer, wherein said glaze layer is formed by printing on said substrate a glass paste of which the glass component comprises a glass powder composition of 20 to 100% by weight of a finely-divided glass powder having an average particle diameter of up to 5 μm and 0 to 80% by weight on the basis of the total amount of said glass powder composition of a glass powder having an average particle diameter of 8 to 20 μm, and by calcining said glass paste on said substrate in such a way that said glaze layer has a plurality of bubbles.

8. A method for producing a thermal head as claimed in claim 7, wherein said average particle diameter of said finely divided glass powder is from 0.5 to 1.0 μm.

9. A method for producing a thermal head as claimed in claim 7, wherein said glass paste on said substrate is calcined at a temperature that is higher than the softening point of said glass powder mixture by 50° to 150° C.

10. A method for producing a thermal head as claimed in claim 8, wherein said glass paste on said substrate is calcined at a temperature that is higher than the softening point of the glass powder mixture by 50° to 150° C.

* * * * *